US008038476B2

(12) United States Patent
Chen

(10) Patent No.: US 8,038,476 B2
(45) Date of Patent: Oct. 18, 2011

(54) NETWORK CONNECTOR

(75) Inventor: Po-Jung Chen, Taoyuan (TW)

(73) Assignee: U.D. Electronic Corp., Taoyuan, Taoyuan County (TW)

( * ) Notice: Subject to any disclaimer, the term of this patent is extended or adjusted under 35 U.S.C. 154(b) by 0 days.

(21) Appl. No.: 12/871,398

(22) Filed: Aug. 30, 2010

(65) Prior Publication Data

US 2011/0081805 A1 Apr. 7, 2011

(30) Foreign Application Priority Data

Oct. 5, 2009 (TW) ..... 98218319 U

(51) Int. Cl.
*H01R 13/66* (2006.01)

(52) U.S. Cl. ..... 439/620.13; 439/620.11; 439/620.17

(58) Field of Classification Search ..... 439/620.11, 439/620.13, 620.17, 620.18
See application file for complete search history.

(56) References Cited

U.S. PATENT DOCUMENTS

| | | | | |
|---|---|---|---|---|
| 7,156,699 | B1 * | 1/2007 | Liu | 439/607.55 |
| 7,611,383 | B1 * | 11/2009 | Huang | 439/620.17 |
| 2005/0101189 | A1 * | 5/2005 | Wan et al. | 439/620 |
| 2008/0171454 | A1 * | 7/2008 | Liu et al. | 439/74 |

* cited by examiner

*Primary Examiner* — Hien Vu
(74) *Attorney, Agent, or Firm* — Muncy, Geissler, Olds & Lowe, PLLC

(57) ABSTRACT

A network connector includes an electrically insulative housing accommodating an output circuit board and an input circuit board, output terminals and input terminals respectively and electrically bonded to the output circuit board and the input circuit board, a filter capacitor electrically connected between the input circuit board and the output circuit board, an electrically insulative partition block mounted in the electrically insulative housing to keep the filter capacitor away from the input circuit board and the output circuit board and to avoid accidental electrical sparks between the input terminals and the filter capacitor, and a filter module having filter coils electrically bonded to the surface contacts at the output circuit board and the input circuit board by surface mount technology.

5 Claims, 7 Drawing Sheets

NETWORK CONNECTOR

This application claims the priority benefit of Taiwan patent application number 098218319, filed on Oct. 5, 2010.

BACKGROUND OF THE INVENTION

1. Field of the Invention

The present invention relates to network technology and more particularly, to a network connector, which has the lead wires of filter coils of a filter module thereof respectively bonded to respective surface contacts at an input circuit board and an output circuit board by surface mount technology, minimizing contact points, simplifying the manufacturing process, lowering the manufacturing cost and enhancing the electrical characteristics.

2. Description of the Related Art

Nowadays, following fast development of computer technology, computer data transmission speed has been greatly improved. Moreover, as network communication technologies develop rapidly and vigorously, it is possible for the people to transmit data, to hold a video conference, to book tickets, to play on-line games, and to inquire information and different application procedures through the internet. Nowadays, many people use the internet to achieve different works. In consequence, many kinds of network connectors have been created as communication means between a computer and an external network. Regular network connectors, for example, RJ-45 connectors, are commonly used for digital communication. During the use of a network connector, the problem of signal interference due to electromagnetic effect must be taken into account. The interference of noises may come from two sources, i.e., the interference of surrounding electromagnetic waves and the interference of internal noises. A network connector may produce high frequency waves to interfere with surrounding electronic devices. Further, the transmitting signal in a network connector may be interfered with noises produced by the external transmission line. In order to eliminate interference, a network connector may have a metal shield surrounded on the outside for protection against external electromagnetic waves and a filter module installed therein to eliminate internal noises, maintaining the quality of the signal being transmitted to the host for data processing.

Further, the cable of a network system may be directly arranged on the outside of the building and exposed to the weather. High voltage generated by thunder or lightning may be transmitted through the cable to the host computer or server of the network system, causing the host computer or server to burn out. When the electronic devices in an electronic apparatus are attacked by lightning surge, the electronic apparatus may fail, or may be damaged permanently. Therefore, network connectors commonly have high voltage capacitor and surge protector means installed therein for protection against high voltage surge.

FIGS. 7 and 8 illustrate a network connector according to the prior art. According to this prior art design, the network connector comprises a base block A, two sets of terminals A1; A4 arranged on left and right sides of the base block A, an accommodation space A0 defined in the base block A between the terminals A1; A4, a plurality of filter members B accommodated in the accommodation space A0, a circuit board A2 attached to the accommodation space A0 and having metal contacts A21 respectively bonded with the terminals A1, an electrically insulative housing A3 attached to the base block A, a back panel A31 attached to the rear side of the electrically insulative housing A3, a plurality of LEDs A32 mounted in the electrically insulative housing A3 and having lead-out wires A321 inserted through the back panel A31 to the outside, and a metal shield C surrounding the electrically insulative housing A3, the base block A and the back panel A31. The metal shield C defines an insertion hole C1 for insertion of an external electrical connector (electrical plug). The filter members B include one filter capacitor B2 and a plurality of filter coils B1. The filter capacitor B2 has two end pins B21 respectively extended from the two opposite ends thereof. One end pin B21 is bonded to the metal contacts A21 of the circuit board A2. The other end pin B21 is extended through the back panel A31 to the outside and connected to the metal shield C. The filter coils B1 of the filter members B are respectively wound round head ends A11 of the terminals A1. Further, the terminals A1 that are arranged on the left side of the base block A are positioned in the insertion hole C1 for the contact of the terminals of the inserted external electrical connector (electrical plug).

The assembly process of the aforesaid prior art network connector is complicated. During connection between the filter coils B1 and the terminals A1, the filter coils B1 must be respectively wound round the head ends A11 of the terminals A1, wasting much time and labor. Further, after bonding of the end pin B21 of the filter capacitor B2 and a plurality of filter coils B1 to the metal contacts A21 of the circuit board A2, no any isolation means is set between the end pin B21 of the filter capacitor B2 and the terminals A4. When the network connector receives an external high voltage, electrical sparks may be produced between the end pin B21 of the filter capacitor B2 and the terminals A4. Further, after extended through the back panel A31 to the outside of the electrically insulative housing A3, the end pin B21 of the filter capacitor B2 and the lead-out wires A321 of the LEDs A32 are not well shielded and isolated, and electrical sparks may be produced between the end pin B21 of the filter capacitor B2 and the lead-out wires A321 of the LEDs A32 accidentally. Therefore, the aforesaid prior art network connector has the drawbacks of complicated structure, high manufacturing cost and low voltage withstand strength.

Therefore, it is desirable to provide a network connector that eliminates the aforesaid problems.

SUMMARY OF THE INVENTION

The present invention has been accomplished under the circumstances in view. It is one object of the present invention to provide a network connector, which has the lead wires of filter coils of a filter module thereof respectively bonded to respective surface contacts at an input circuit board and an output circuit board by surface mount technology, simplifying the manufacturing process, lowering the manufacturing cost and enhancing the electrical characteristics.

It is another object of the present invention to provide a network connector, which has an electrically insulative holder panel and an electrically insulative partition block mounted in an electrically insulative housing thereof to keep a filter capacitor away from the input circuit board and the output circuit board, avoiding accidental electrical sparks between the input terminals that are bonded to the input circuit board and the filter capacitor that is electrically connected between the input circuit board and the output circuit board upon a surge, and enhancing the network's voltage withstand strength.

DETAILED DESCRIPTION OF THE PREFERRED EMBODIMENT

Figure 1:
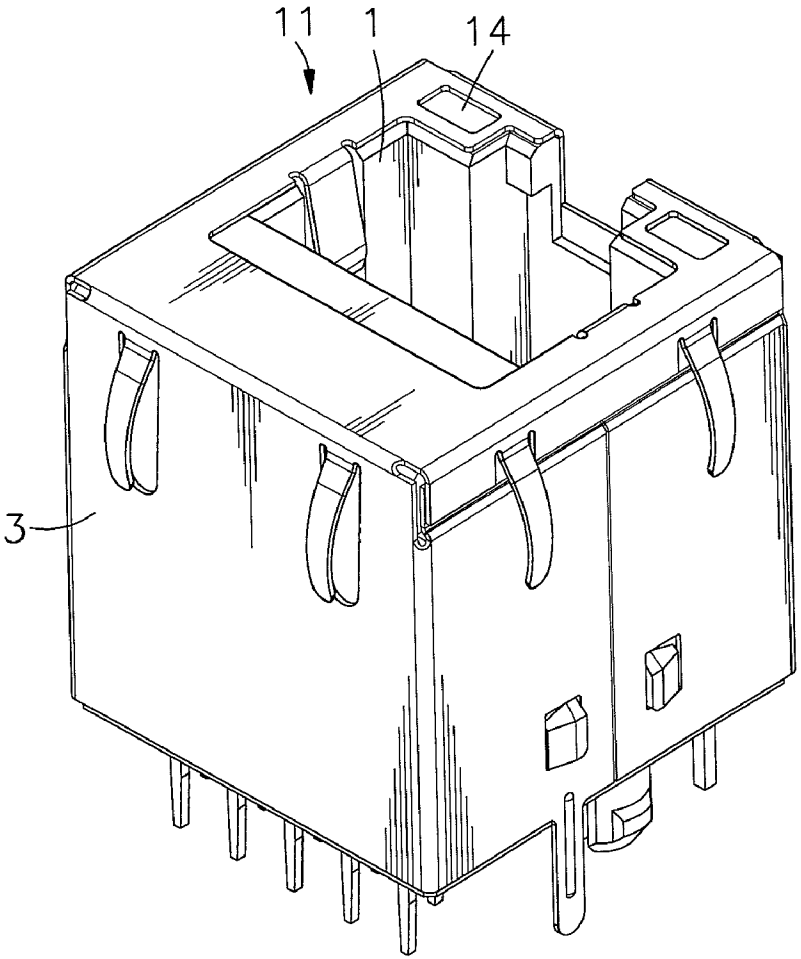
FIG. 1 is an oblique elevation of a network connector in accordance with the present invention.
Figure 2:
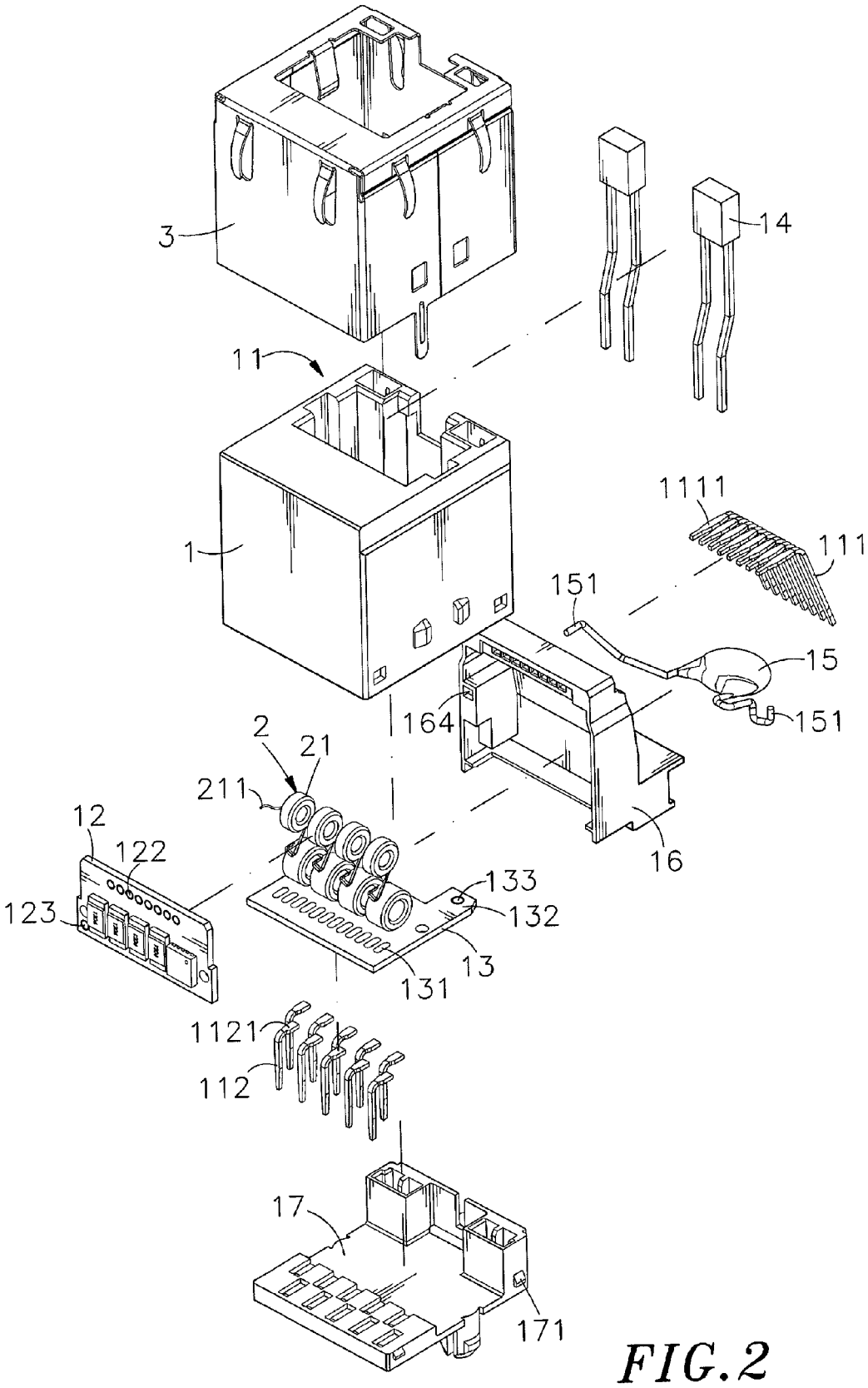
FIG. 2 is an exploded view of the network connector in accordance with the present invention.
Figure 3:
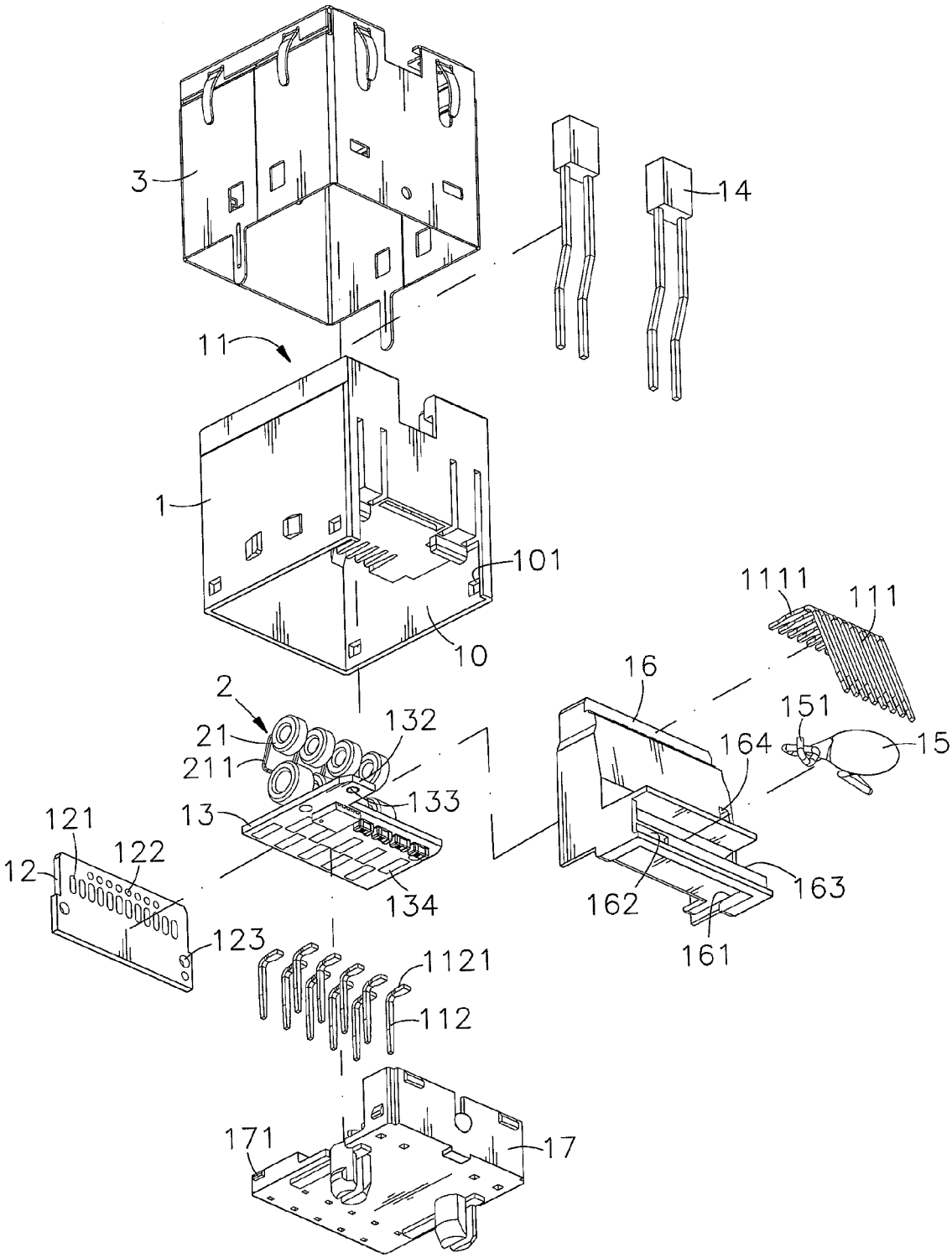
FIG. 3 is another exploded view of the network connector in accordance with the present invention when viewed from another angle.
Figure 4:
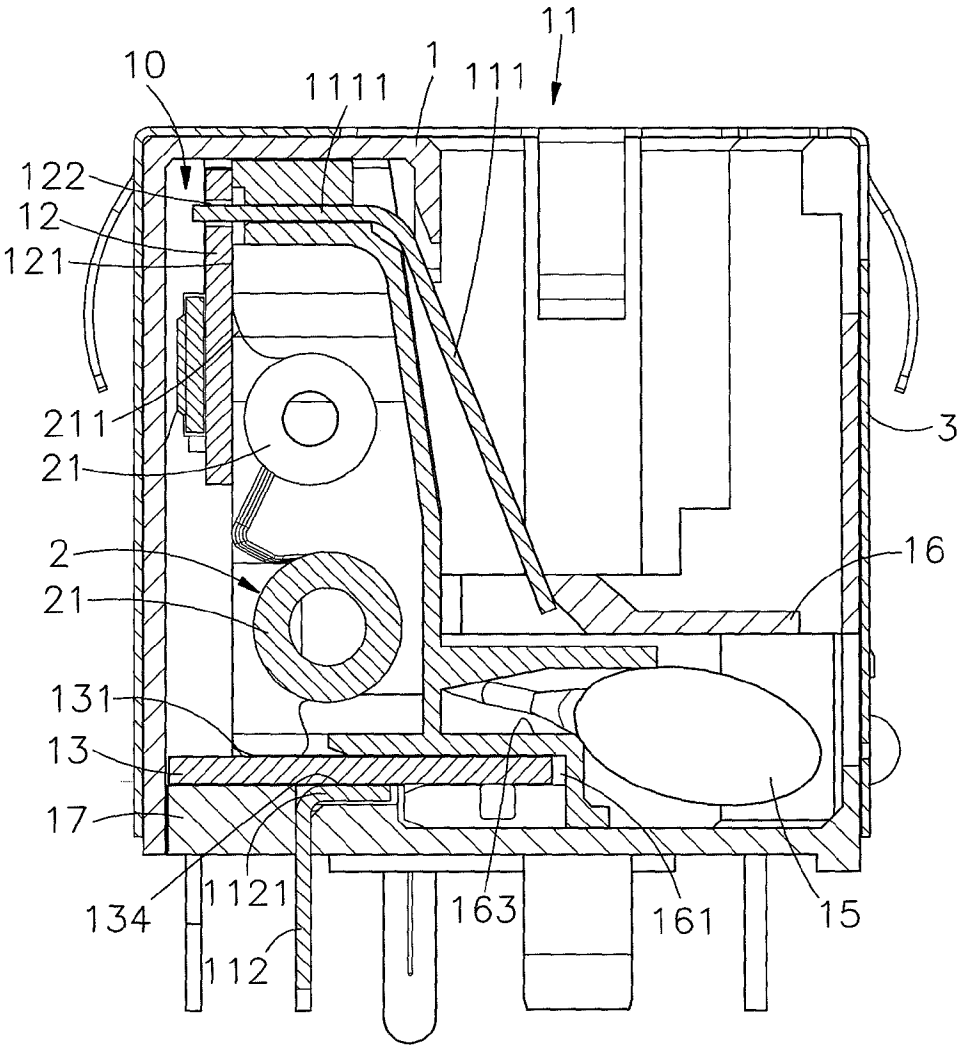
FIG. 4 is a sectional side view of the network connector in accordance with the present invention.

Referring to FIGS. 1-4, a network connector in accordance with the present invention is shown comprising an electrically insulative housing 1 having an insertion hole 11 on its one side, i.e., the front side, an output circuit board 12 and an input circuit board 13 mounted in the electrically insulative housing 1, a plurality of output terminals 111 mounted in the insertion hole 11 of the electrically insulative housing 1 and electrically connected to the output circuit board 12, a plurality of input terminals 112 electrically connected to the input circuit board 13 and extending out of the opposite side, namely, the bottom side of the electrically insulative housing 1, and a filter module 2 that comprises a plurality of filter coils 21 bonded to surface contacts 121 at the output circuit board 12 and surface contacts 131 at the input circuit board 13 by surface mount technology.

Further, the electrically insulative housing 1 has mounted therein LEDs 14, a filter capacitor 15, an electrically insulative partition block 16 and an electrically insulative holder panel 17. The electrically insulative housing 1 further has a mounting chamber 10 in the bottom side thereof. The insertion hole 11 of the electrically insulative housing 1 is configured to receive an external RJ-45 male connector. When an external RJ-45 male connector is inserted into the insertion hole 11 of the electrically insulative housing 1, the inserted RJ-45 male connector is electrically kept in contact with the output terminals 111. Further, the electrically insulative partition block 16 and the electrically insulative holder panel 17 are properly mounted in the mounting chamber 10 of the electrically insulative housing 1.

Figure 5:
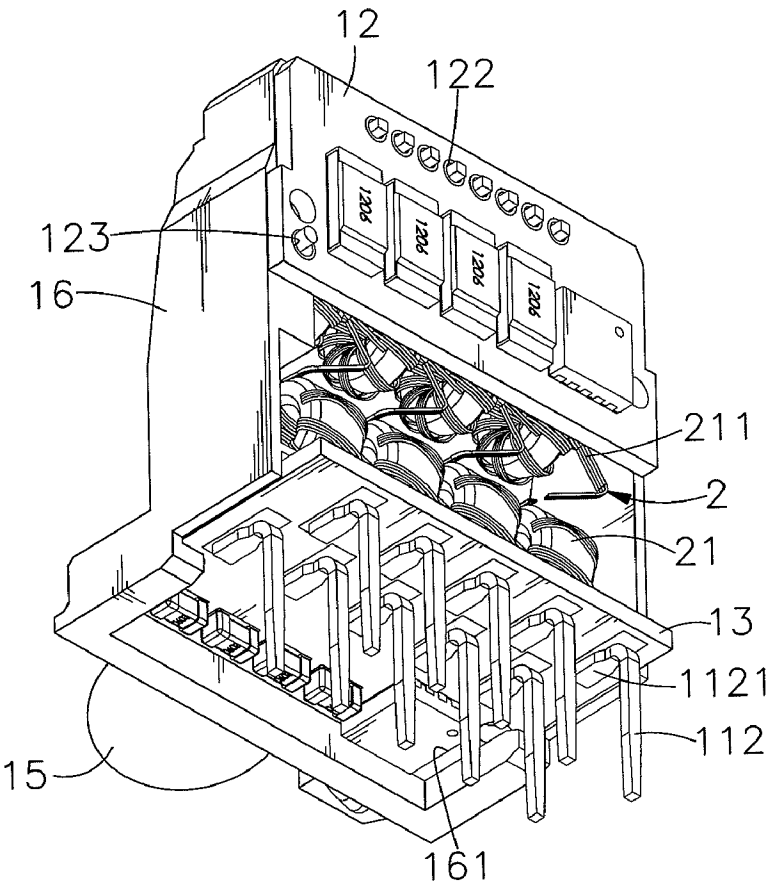
FIG. 5 is an elevational assembly view of a part of the network connector in accordance with the present invention.
Figure 6:
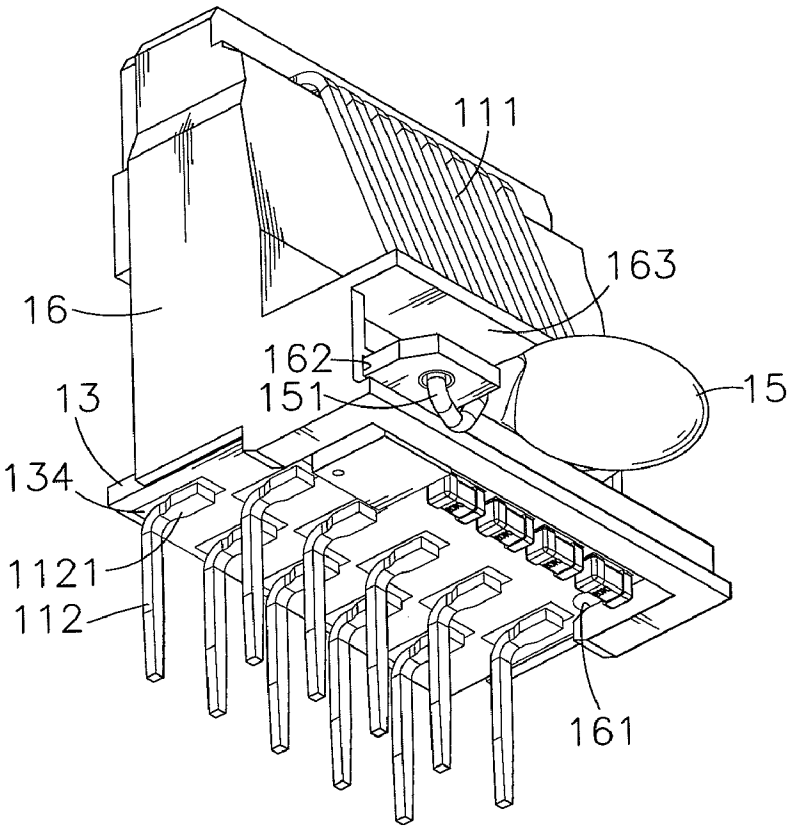
FIG. 6 corresponds to FIG. 5 when viewed from another angle.
Figure 7:
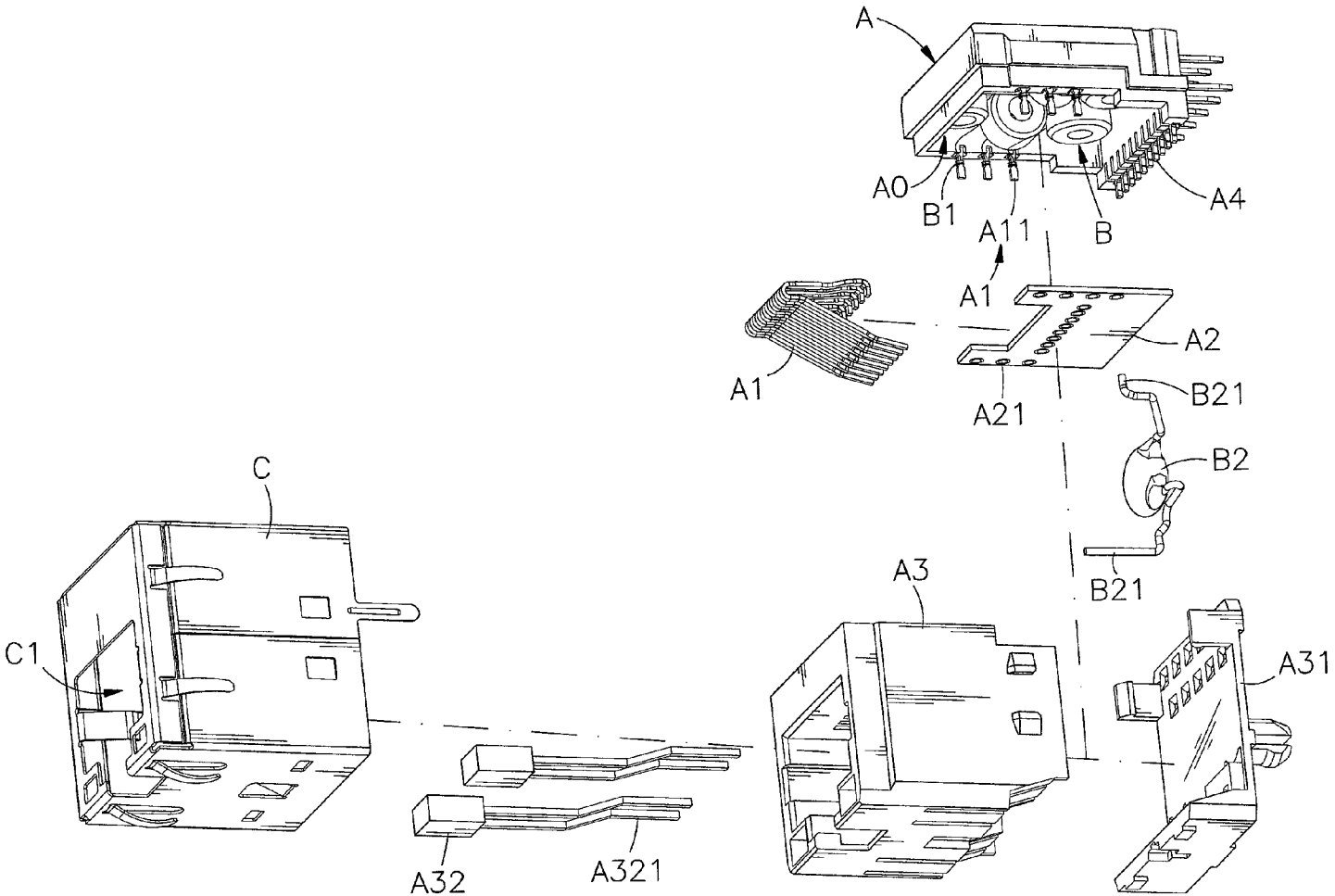
FIG. 7 is an exploded view of a network connector according to the prior art.
Figure 8:
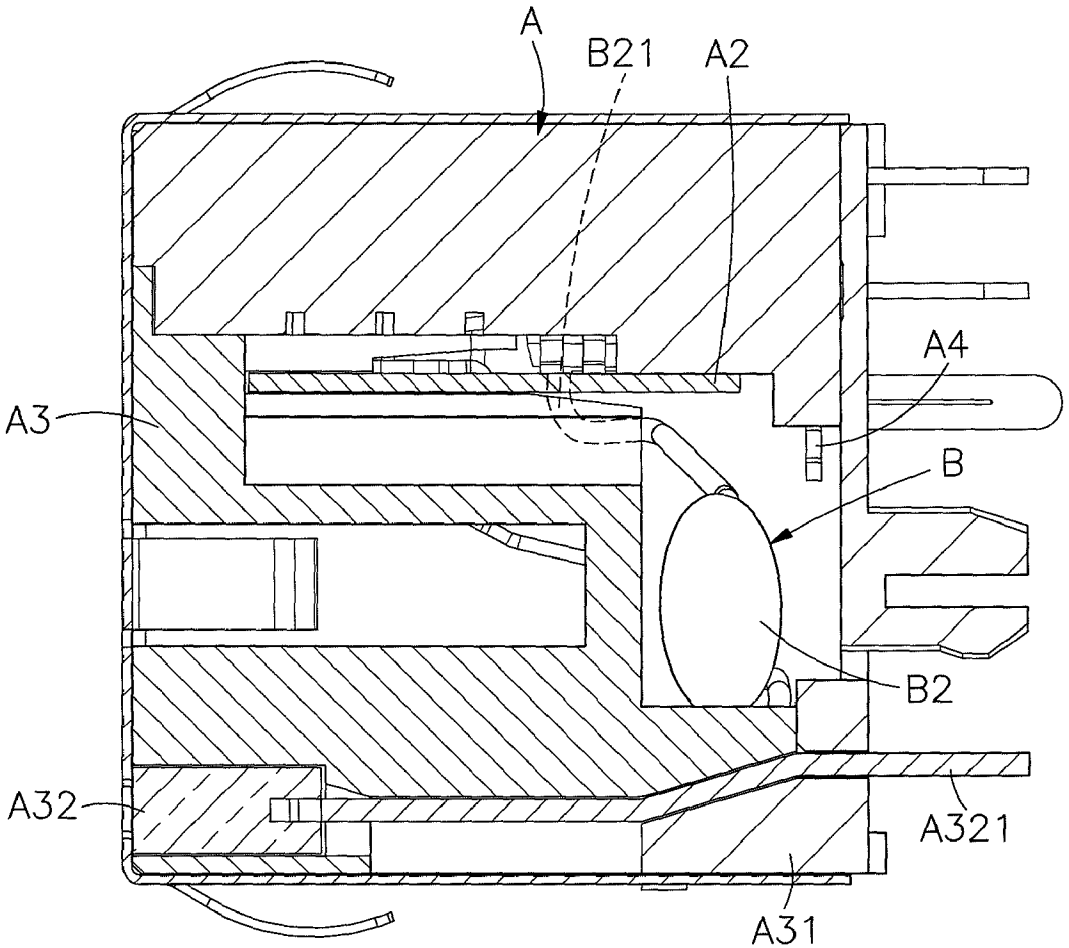
FIG. 8 is a sectional side view of the network connector according to the prior art.

Referring to FIGS. 5 and 6 and FIG. 2 again, the filter coils 21 of the filter module 2 each have opposing lead wires 211 respectively bonded to the surface contacts 121 of the output circuit board 12 and the surface contacts 131 of the input circuit board 13 by surface mount technology. After bonding of the filter coils 21 of the filter module 2 to the output circuit board 12 and the input circuit board 13, the assembly of the filter module 2, output circuit board 12 and input circuit board 13 is mounted in the electrically insulative partition block 16, and then bonding ends 1111 of the output terminals 111 are inserted through the electrically insulative partition block 16 into respective via holes 122 of the output circuit board 12 and bonded thereto. Further, the input circuit board 13 is fastened to a locating groove 161 at the back side of the electrically insulative partition block 16, and kept perpendicular to the input circuit board 13. The input circuit board 13 has an extension portion 132 inserted through a slot 162 of the electrically insulative partition block 16. The filter capacitor 15 is mounted in a locating hole 163 of the electrically insulative partition block 16, having two pins 151 respectively extended from its two opposite ends. One pin 151 of the filter capacitor 15 is inserted through a through hole 164 of the electrically insulative partition block 16 and bonded to a via hole 123 of the output circuit board 12. The other pin 151 of the filter capacitor 15 is inserted through a through hole 133 and bonded to a via hole 133 on the extension portion 132 of the input circuit board 13. The input terminals 112 each have a bonding end 1121 respectively bonded to a respective contact 134 at the back side of the input circuit board 13 by hot press soldering. Thereafter, the assembly of the filter module 2, output circuit board 12, input circuit board 13, output terminals 111, input terminals 112 and electrically insulative partition block 16 are properly mounted in the mounting chamber 10 of the electrically insulative housing 1, and then the LEDs 14 are mounted in the electrically insulative housing 1, and then the electrically insulative holder panel 17 is attached to the bottom side of the electrically insulative housing 1 to force multiple retaining blocks 171 at the two opposite lateral sides thereof into engagement with respective retaining holes 101 in the electrically insulative housing 1, thereby closing the mounting chamber 10. Thus, the electrically insulative holder panel 17 lifts the assembly of the filter module 2, output circuit board 12, input circuit board 13, output terminals 111, input terminals 112 and electrically insulative partition block 16 in the mounting chamber 10 of the electrically insulative housing 1. At final, a metal shield 3 is mounted around the electrically insulative housing 1, finishing the assembly process of the network connector.

Further, after installation of the electrically insulative holder panel 17 and the electrically insulative partition block 16 in the electrically insulative housing 1, the bonding ends 1121 of the input terminals 112 are isolated, avoiding accidental electrical sparks between the bonding ends 1121 of the input terminals 112 and the pins 151 of the filter capacitor 15, and enhancing the network's voltage withstand strength.

Further, the lead wires 211 of the filter coils 21 of the filter module 2 are respectively bonded to the surface contacts 121 of the output circuit board 12 and the surface contacts 131 of the input circuit board 13 by surface mount technology but not wound round the output terminals 111 and the input terminals 112. Thus, the installation of the filter coils 21 of the filter module 2 is simplified to lower the manufacturing cost. Further, this filter module installation design also enhances the electrical characteristics during signal transmission.

As stated above, the scope of the present invention is to directly bond the lead wires 211 of the filter coils 21 of the filter module 2 to the surface contacts 121 of the output circuit board 12 and the surface contacts 131 of the input circuit board 13 by surface mount technology, minimizing contact points in the network connector and avoiding signal attenuation during signal transmission. By means of bonding the lead wires 211 of the filter coils 21 of the filter module 2 to the surface contacts 121 of the output circuit board 12 and the surface contacts 131 of the input circuit board 13 directly by surface mount technology without winding the lead wires 211 of the filter coils 21 of the filter module 2 round the output terminals 111 and the input terminals 112, the installation of the filter coils 21 of the filter module 2 is simplified, lowering the manufacturing cost and enhancing electrical characteristics during signal transmission.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A network connector, comprising:

an insulative housing, said insulative housing having an insertion hole defined in a front side thereof for the insertion of an external electrical connector;

an output circuit board and an input circuit board mounted in said insulative housing, said output circuit board and said input circuit board each having a plurality of surface contacts;

a plurality of output terminals mounted in said insertion hole inside said insulative housing and electrically connected to said output circuit board for signal output;

a plurality of input terminals electrically connected to said input circuit board and extending out a bottom side of said insulative housing opposite to said insertion hole for signal input;

a filter capacitor mounted in said insulative housing and electrically connected between said input circuit board and said output circuit board;

a filter module, said filter module comprising a plurality of filter coils electrically bonded to the surface contacts of said output circuit board and the surface contacts of said input circuit board by surface mount technology; and an insulative partition block mounted in said insulative housing to hold said input circuit board and said output circuit board and said filter module therein, said filter capacitor being isolated from said filter module by a wall of said insulative partition block;

wherein said insulative partition block comprises a locating groove and a slot; said input circuit board having an extension portion, said input circuit board is mounted in said locating groove of said insulative partition block and said extension portion inserted through said slot.

2. The network connector as claimed in claim 1, wherein said insulative housing comprises a mounting chamber defined in the bottom side thereof, a plurality of retaining holes formed in said mounting chamber, and an insulative holder panel fastened to the bottom side thereof to close said mounting chamber, said insulative holder panel having a plurality of retaining blocks raised from two opposite lateral sides thereof and respectively forced into engagement with said retaining holes.

3. The network connector as claimed in claim 1, wherein said output circuit board comprises a plurality of via holes; said output terminals each have a bonding end respectively bonded to the via holes of said output circuit board.

4. The network connector as claimed in claim 1, wherein said filter capacitor has a first pin extended from one end thereof and inserted through said insulative partition block and electrically bonded to a via hole on said output circuit board, and a second pin extended from an opposite end thereof and electrically bonded to a via hole on the extension portion of said input circuit board.

5. The network connector as claimed in claim 1, wherein said insulative housing comprises an insulative holder panel fastened to a bottom side thereof; said input circuit board is set between said insulative partition block and said insulative holder panel, having a plurality of contacts arranged on a back side thereof; said input terminals each have a bonding end inserted through said insulative holder panel and bonded to one contact at the back side of said input circuit board.

* * * * *